US006062885A

United States Patent [19]

White

[11] Patent Number: 6,062,885

[45] Date of Patent: May 16, 2000

[54] ELECTRICAL SWITCH ASSEMBLY

[75] Inventor: Pat White, Ennis, Ireland

[73] Assignee: Molex Incorporated, Lisle, Ill.

[21] Appl. No.: 09/298,242

[22] Filed: Apr. 23, 1999

[51] Int. Cl.[7] ..... H01R 29/00; H01R 33/96

[52] U.S. Cl. ..... 439/188; 436/668; 200/51.09; 200/51.1

[58] Field of Search ..... 439/188, 668; 200/51.09, 51.1

[56] References Cited

U.S. PATENT DOCUMENTS

| | | | |
|---|---|---|---|
| 3,949,180 | 4/1976 | Ojima et al. | 200/51.1 |
| 4,393,283 | 7/1983 | Masuda | 200/51.09 |
| 4,659,167 | 4/1987 | Masuda | 339/182 |
| 4,695,116 | 9/1987 | Bailey et al. | 439/188 |
| 4,861,281 | 8/1989 | Warner | 439/540 |
| 5,226,042 | 7/1993 | Hampel | 439/188 |
| 5,277,628 | 1/1994 | Lin et al. | 439/668 |
| 5,338,215 | 8/1994 | Lee et al. | 439/188 |
| 5,893,767 | 4/1999 | Broschard, III | 439/188 |

FOREIGN PATENT DOCUMENTS

WO98/54797 12/1998 WIPO .

*Primary Examiner*—Stanley J. Witkowski
*Attorney, Agent, or Firm*—Stephen Z. Weiss

[57] ABSTRACT

An electrical switch assembly includes a first switch contact stamped and formed of sheet metal material and including a base. An integral spring contact arm is folded into cantilevered position back over the base. The spring contact arm has a distal end with a first contact surface facing away from the base. A second switch contact has a second contact surface facing the base of the first switch contact in position of opposing engagement with the first contact surface. Therefore, movement of the spring contact arm of the first switch contact toward the base thereof causes the first contact surface to move away from the second contact surface of the second switch contact.

10 Claims, 2 Drawing Sheets

ELECTRICAL SWITCH ASSEMBLY

FIELD OF THE INVENTION

This invention generally relates to the art of electrical switches and, particularly, to a blade-type switch as might be used in stereo audio equipment, mobile phones and the like.

BACKGROUND OF THE INVENTION

With the ever-increasing miniaturization of electronic equipment, such as audio and video equipment, mobile telephones, computer and other equipment, it becomes increasingly difficult to design electrical circuitry. One area of such difficulty is electrical switches or switch assemblies. An electrical switch assembly may be used as a normally open switch with switch contacts designed to be closed upon actuating the switch, or the switch assembly may be a normally closed switch with the contacts designed to be opened when the switch is actuated.

Heretofore, electrical switch assemblies have caused problems in designing compact or miniaturized circuitry for such equipment as described above, because the switch assemblies were comprised of multiple components. These problems are magnified when the switch components are used for functions other than their switching functions, such as retaining a component such as a stereo plug in the switch assembly. The present invention is directed to solving these problems and satisfying a need for an extremely simple and cost-effective switch assembly.

SUMMARY OF THE INVENTION

An object, therefore, of the invention is to provide a new and improved electrical switch assembly of the character described.

In the exemplary embodiment of the invention, the switch assembly includes a first switch contact stamped and formed of sheet metal material and including a base and an integral spring contact arm folded into cantilevered position back over the base. The spring contact arm has a distal end with a first contact surface offset to one side of the spring contact arm and facing away from the base. A second switch contact has a second contact surface facing the base of the first switch contact in position of opposing engagement with the first contact surface. Therefore, movement of the spring contact arm of the first switch contact toward the base thereof causes the first contact surface to move away from the second contact surface of the second switch contact and, thereby, open the switch assembly.

As disclosed herein, the distal end of the spring contact arm is folded back under the arm. The first contact surface at the distal end of the spring contact arm is offset to one side of the spring contact arm. The second switch contact extends along the one side of the spring contact arm of the first switch contact.

Other features of the invention include the spring contact arm having a rounded actuation portion near the distal end thereof and projecting therefrom in a direction away from the base. This rounded actuation portion facilitates retaining a component, such as a stereo plug, in the switch assembly. The folded-back distal end of the spring contact arm also has an under surface for engaging the base and providing an anti-overstress means for the spring contact arm.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the Figures and in which.

DETAILED DESCRIPTION OF THE PREFERRED EMBODIMENT

Figure 1:
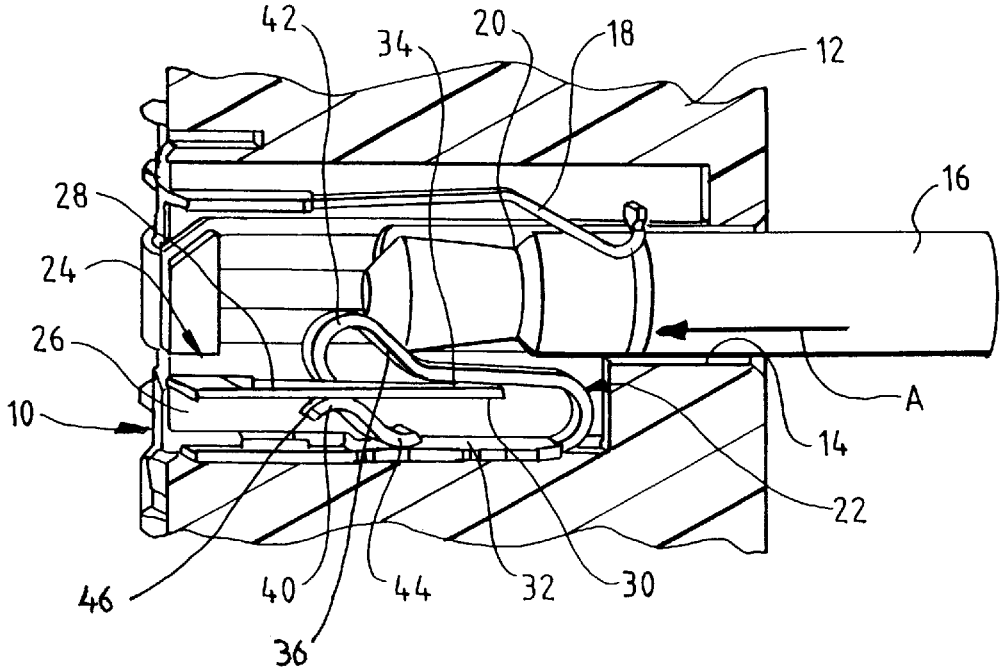
FIG. 1 is a section through a housing which mounts the switch assembly of the invention, with the switch in its normally closed condition.

Referring to the drawings in greater detail, the invention is embodied in an electrical switch assembly, generally designated 10, mounted within a housing 12. The housing may be part of appropriate equipment which includes a receptacle 14 for receiving a stereo plug 16 inserted into the receptacle in the direction of arrow "A". Switch assembly 10 is mounted at one side of the receptacle for engagement by the plug, as described hereinafter, and a plug contact 18 is mounted in the housing at the opposite side of the receptacle. As is known, plug 16 has a recessed area 20 near its distal end.

Generally, switch assembly 10 includes a first switch contact, generally designated 22, and a second switch contact, generally designated 24. The second switch contact may be stamped and formed of sheet metal material and has a base 26 mounting the contact in the housing and a contact blade 28 defining a second contact surface 30.

Figure 3:
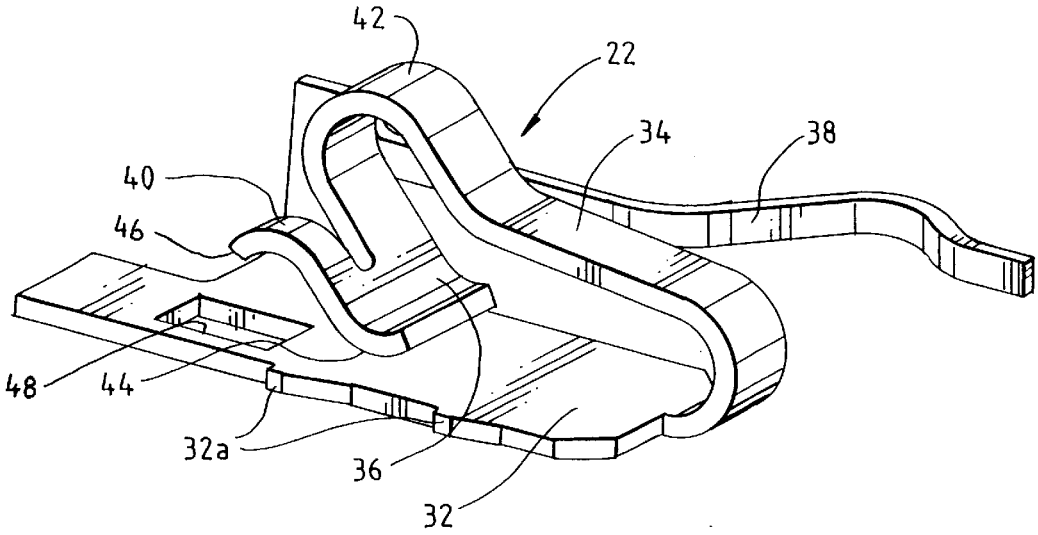
FIG. 3 is a perspective view of the first switch contact of the switch assembly.
Figure 4:
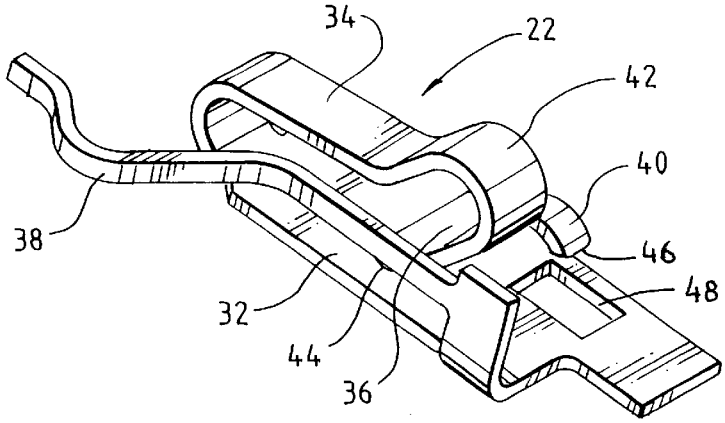
FIG. 4 is a perspective view looking at the opposite side of the first switch contact in FIG. 3.

Referring to FIGS. 3 and 4 in conjunction with FIG. 1, first switch contact 22 is stamped and formed of sheet metal material. The first switch contact includes a base 32 for mounting the contact in housing 12. For instance, the base may have teeth 32*a* at one or both opposite edges thereof for skiving into the material of the housing which may be molded of plastic material. An integral spring contact arm 34 is folded into cantilevered position back over base 32. The spring contact arm has a distal end 36 which is folded back under the arm. A terminating tail 38 projects from base 32 and may comprise a tail portion for connection, as by soldering, to a printed circuit board mounted in housing 12.

First switch contact 22 performs various functions, all of the functions being concentrated about distal end 36 of spring contact arm 34. First of all, a first contact surface 40 is offset to one side of the spring contact arm in position for opposing engagement with second contact surface 30 (FIG. 1) of second switch contact 24. Therefore, as seen in FIG. 1, switch assembly 10 is a normally closed switch.

Another function is performed by a rounded actuation portion 42 at distal end 36 of spring contact arm 34, with the actuation portion projecting from the arm in a direction away from base 32. As will be seen hereinafter in relation to FIG. 2, this rounded actuation portion facilitates holding stereo plug 16 within receptacle 14.

Still a further function is performed by an under surface 44 beneath distal end 36 of spring contact arm 34. Under surface 44 is engageable with base 32 to provide an anti-overstress means for spring contact arm 34.

Figure 2:
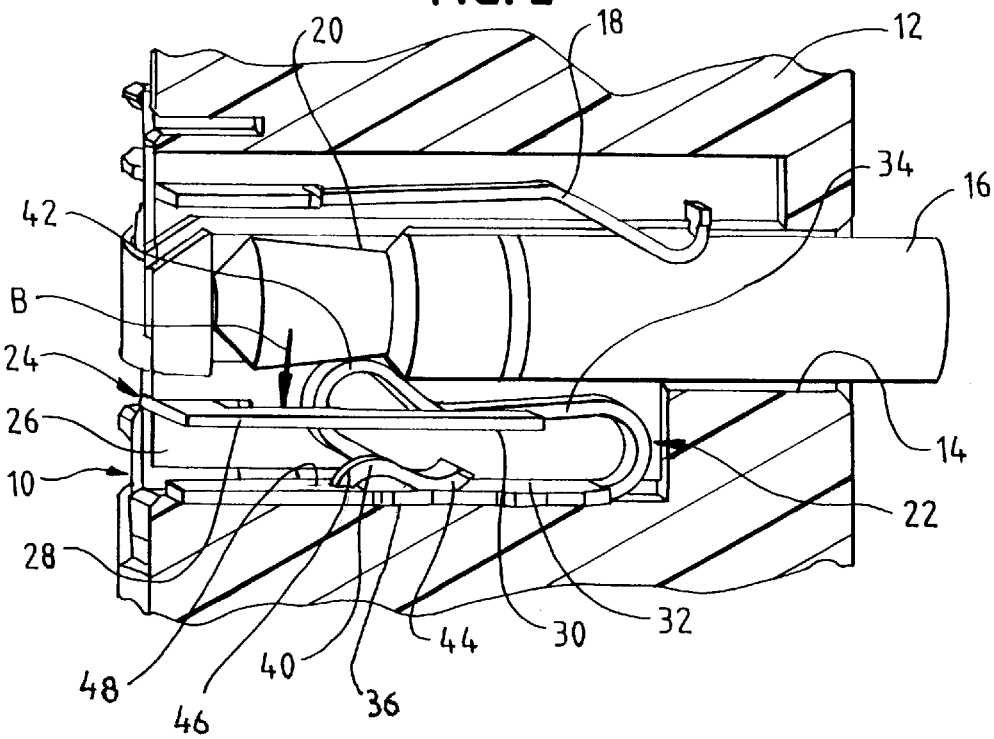
FIG. 2 is a view similar to that of FIG. 1, with the switch opened by insertion of a stereo plug.

Turning now to FIG. 2, it can be seen that stereo plug 16 has been moved from its inoperative position shown in FIG.

1 to an operative position whereby the plug has engaged actuation portion 42 of spring contact arm 34 and has biased the spring contact arm outwardly of the plug in the direction of arrow "B". This causes first contact surface 40 of first switch contact 22 to move away from second contact surface 30 of second switch contact 24. Therefore, the normally closed switch provided by switch assembly 10 is opened in response to insertion of stereo plug 16 into receptacle 14 of housing 12.

Finally, FIG. 2 also shows that rounded actuating portion 42 of spring contact arm 34 seats within recessed area 20 of the stereo plug. This facilitates retaining the plug in the receptacle. To accommodate the movement of the end 46 of the offset first contact surface 40 toward the base 32, an opening 48 is provided in the base.

FIGS. 3 and 4 show the first switch contact 22 in detail. Flexible arm 38 extends from one side of this contact. The purpose of this flexible arm is to engage a conductive trace on a printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical switch assembly, comprising:

a first switch contact stamped and formed of sheet metal material and including a base and an integral spring contact arm folded into cantilevered position back over the base, the spring contact arm having a distal end with a first contact surface offset to one side of the spring contact arm and facing away from the base; and a second switch contact having a second contact surface facing the base of the first switch contact in position of opposing engagement with said first contact surface, whereby movement of the spring contact arm of the first switch contact toward the base thereof causes the first contact surface to move away from the second contact surface of the second switch contact.

2. The electrical switch contact assembly of claim 1 wherein said second switch contact extends along said one side of the spring contact arm of the first switch contact.

3. The electrical switch contact assembly of claim 1 wherein said spring contact arm has a rounded actuation portion near the distal end thereof and projecting therefrom in a direction away from said base.

4. The electrical switch contact assembly of claim 1 wherein the distal end of said spring contact arm is folded back under the arm.

5. The electrical switch contact assembly of claim 4 wherein said folded-back distal end of the spring contact arm has an under surface for engaging the base and providing a anti-overstress means for the spring contact arm.

6. An electrical switch assembly, comprising:

a first switch contact stamped and formed of sheet metal material and including a base and an integral spring contact arm folded into cantilevered position back over the base, the spring contact arm having a distal end folded back under the arm, the distal end having a first contact surface facing away from the base, with the first contact surface being offset to one side of the spring contact arm; and a second switch contact having a second contact surface facing the base of the first switch contact in position of opposing engagement with said first contact surface, whereby movement of the spring contact arm of the first switch contact toward the base thereof causes the first contact surface to move away from the second contact surface of the second switch contact.

7. The electrical switch contact assembly of claim 6 wherein said second switch contact extends along said one side of the spring contact arm of the first switch contact.

8. The electrical switch contact assembly of claim 6 wherein said spring contact arm has a rounded actuation portion near the distal end thereof and projecting therefrom in a direction away from said base.

9. The electrical switch contact assembly of claim 6 wherein said folded-back distal end of the spring contact arm has an under surface for engaging the base and providing a anti-overstress means for the spring contact arm.

10. The electrical switch contact assembly of claim 6 wherein said first switch contact includes a terminating tail projecting from the base at a side thereof opposite said one side of the spring contact arm.

* * * * *